US007562724B2

(12) United States Patent
Allred et al.

(10) Patent No.: US 7,562,724 B2
(45) Date of Patent: Jul. 21, 2009

(54) ROD TRANSFER MECHANISM SYNCHRONIZER APPARATUS AND METHOD

(75) Inventors: Terry Allred, Corydon, IA (US); Matt Mills, Pella, IA (US); Mickey Gragg, Whatcheer, IA (US); Jeff Vander Molen, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 241 days.

(21) Appl. No.: 11/330,825

(22) Filed: Jan. 12, 2006

(65) Prior Publication Data

US 2007/0158110 A1 Jul. 12, 2007

(51) Int. Cl.
*E21B 19/14* (2006.01)

(52) U.S. Cl. ..... 175/85; 175/52; 414/22.53; 414/22.62

(58) Field of Classification Search ..... 175/52, 175/85; 414/22.52, 22.53, 22.62
See application file for complete search history.

(56) References Cited

U.S. PATENT DOCUMENTS

| | | | | |
|---|---|---|---|---|
| 5,556,253 | A | 9/1996 | Rozendaal et al. | |
| 5,607,280 | A | 3/1997 | Rozendaal | |
| 6,074,153 | A * | 6/2000 | Allen | 414/22.53 |
| 6,332,502 | B1 | 12/2001 | Mills et al. | |
| 6,360,830 | B1 | 3/2002 | Price | |
| 6,374,928 | B1 | 4/2002 | Teller et al. | |
| 6,474,931 | B1 | 11/2002 | Austin et al. | |
| 6,474,932 | B1 | 11/2002 | Rush | |
| 6,533,046 | B2 | 3/2003 | Mills et al. | |
| 6,543,551 | B1 | 4/2003 | Sparks et al. | |
| 6,651,755 | B1 | 11/2003 | Kelpe | |
| 6,845,825 | B2 | 1/2005 | Bischel et al. | |
| 6,886,644 | B2 | 5/2005 | Stump et al. | |
| 7,182,151 | B2 | 2/2007 | Stump et al. | |
| 2002/0079137 | A1 | 6/2002 | Mills et al. | |
| 2005/0199424 | A1 | 9/2005 | Stump et al. | |

* cited by examiner

*Primary Examiner*—Giovanna C Wright
(74) *Attorney, Agent, or Firm*—Merchant & Gould P.C.

(57) ABSTRACT

A synchronizer device is used for coordinating drill rod transfer mechanisms utilized in connection with transferring the drill rod between a drill rod magazine and the drill string in a horizontal directional drilling rig. The synchronizer device may transfer the movement from a first transfer mechanism to a second transfer mechanism, wherein the first transfer mechanism is powered and the apparatus acts as the motive force to move a second non-powered transfer mechanism. Alternatively, the synchronizer device may coordinate and synchronize the movement between a first and a second powered transfer mechanism. The synchronizer shaft is rotationally supported by bearings mounted on the rack frame of an HDD rig. The synchronizer shaft includes a longitudinal axis, a first end, and a second end. First and second ears are mounted on or proximate the first end and the second end of the synchronizer shaft respectively. First and second links are pivotally connected to the first ear and the second ear respectively at a first end of the links. The links are arranged and configured to connect to upper and lower rod transfer mechanisms respectively at a second end of the links.

17 Claims, 5 Drawing Sheets

ROD TRANSFER MECHANISM SYNCHRONIZER APPARATUS AND METHOD

FIELD OF THE INVENTION

The present invention relates generally to equipment used for horizontal ground boring; more specifically to a method and apparatus for manipulating drill rod used in horizontal directional drilling; and more particularly still to a method and apparatus for synchronizing the drill rod transfer mechanisms utilized in connection with transferring the drill rod between a drill rod magazine and the drill string.

BACKGROUND

Horizontal directional drilling, commonly referred to as HDD, is a process used in a number of applications such as installing utilities underground. The HDD process, regardless of the application, includes a pilot hole-boring step. In this step a bore hole is created that extends underground—generally horizontally or generally parallel to the surface of the earth—starting at a launch point and ending at a termination point.

The bore hole is created by positioning a boring machine to rotate and push a drill string through the ground. A drill bit is attached to the leading end of the drill string. The drill string is created by connecting individual drill rods together end-to-end from a supply of drill rods stored on the boring machine. The connection between the rods is made up, and subsequently broken in a later step, by the boring machine. A typical boring machine includes a gearbox that connects to the drill string, a drill rod storage magazine, and a rod loading mechanism. The rod loading mechanism moves the individual drill rods from the storage magazine into alignment with the drill string and the gearbox where the individual drill rod is connected to and made a part of the drill string.

Rod loading mechanisms typically include a rod transfer mechanism that moves the rod from the storage magazine and positions it with one end in alignment with the drill string and the other end in alignment with the gearbox. The drill rods are typically long, and connection to the drill string requires that the ends of the drill rod be positioned accurately. Thus, the rod loading mechanisms typically include two pipe transfer mechanisms, one on each end of the drill rod, to maximize the accuracy of positioning the respective ends of the drill rod.

When utilizing two mechanisms, however, a drawback arises in that the movement of the two mechanisms is not always synchronized. This may result in misalignment and/or binding. Therefore, there is a need in the art for a method and apparatus for coordinating and synchronizing the rod transfer mechanisms. The present invention overcomes the shortcomings of the prior art and addresses these needs in the art.

SUMMARY

The present invention generally relates to a method and apparatus for coordinating and synchronizing drill rod transfer mechanisms utilized in connection with transferring the drill rod between a drill rod magazine and the drill string. One aspect of the invention relates to an apparatus and method for transferring the movement from a first transfer mechanism to a second transfer mechanism, wherein the first transfer mechanism is powered and the apparatus acts as the motive force to move a second non-powered transfer mechanism. A second aspect of the invention relates to an apparatus and method for coordinating or synchronizing the movement between a first and a second powered transfer mechanism. A third aspect of the invention relates to an apparatus and method for coordinating the movement between a first and second non-powered transfer mechanism by applying power to a coordinating member.

In one embodiment constructed according to the principles of the present invention, there is provided a synchronizer shaft rotationally supported by bearings mounted on the rack frame of an HDD rig. The synchronizer shaft includes a longitudinal axis, a first end, and a second end. First and second ears are mounted on or proximate the first end and the second end of the synchronizer shaft, respectively. First and second links are pivotally connected to the first ear and the second ear, respectively, at a first end of the links. The links are also arranged and configured to connect to upper and lower rod transfer mechanisms, respectively, at a second end of the links.

In operation, movement of at least one of the upper or lower rod transfer mechanisms causes movement of the link, which pushes/pulls the ear, thereby causing rotation of the synchronizer shaft about its longitudinal axis. The rotation is transferred to the other ear which causes movement of the other link, thereby causing movement of the other upper or lower rod transfer mechanism. In the event that both of the mechanisms are powered, then the synchronizer shaft coordinates the movement between the two powered transfer mechanisms. In the event that neither of the mechanisms are powered, then power is applied to the synchronizer shaft at a third location.

Therefore, according to one aspect of the invention, there is provided a horizontal directional drilling machine, comprising: a drill pipe storage magazine; a boring assembly defining a drill string axis comprising a rack frame with an upper end and a lower end, a gearbox configured to travel along the rack frame from the upper end to the lower end, and a vise assembly a the lower end; an upper drill pipe transfer mechanism configured to move linearly from a retracted position, wherein it is operatively located to receive a drill pipe from the storage magazine, to an extended position, wherein the received drill pipe is aligned with the drill string; a lower drill pipe transfer mechanism configured to move linearly from a retracted position, wherein it is operatively located to receive a drill pipe from the storage magazine, to an extended position, wherein the received drill pipe is aligned with the drill string; and a non-powered drill pipe transfer mechanism synchronizer that connects to the upper drill pipe transfer mechanism and to the lower drill pipe transfer mechanism.

According to another aspect of the invention, there is provided a drill rod transfer mechanism synchronizer apparatus, the mechanism of the type that transfers drill rod from a storage magazine to a drill string in a rack, the apparatus comprising: a first drill rod transfer mechanism being arranged and configured to move from a first receiving position to a second extended position; a second drill rod transfer mechanism arranged and configured to move from a first receiving position to a second extended position, the second drill rod transfer mechanism being located at a physical distance on the rack from the first drill rod transfer mechanism; an elongate member extending between the first and second drill rod transfer mechanisms and rotationally mounted about its longitudinal axis; a first link operatively connected to the first drill rod transfer mechanism and the elongate member, wherein movement of the first drill rod transfer mechanism from the first to the second position causes rotation of the elongate member about its longitudinal axis; and a second link operatively connected to the second drill rod transfer mechanism and the elongate member, wherein movement of the elongate member about its longitudinal axis causes the second drill rod transfer mechanism to move from the first to the second position.

According to yet another aspect of the invention, there is provided a method for synchronizing the movement of a plurality of drill rod transfer mechanisms, the drill rod transfer mechanisms of the type that transfers drill rod from a storage magazine to a drill string in a rack, the method comprising: rotationally mounting an elongate member having a longitudinal axis between a first and a second drill rod transfer mechanism; connecting the first drill rod transfer mechanism to the elongate member, wherein movement of the first drill rod transfer mechanism from a first to a second position causes rotation of the elongate member about its longitudinal axis; and connecting the second drill rod transfer mechanism and the elongate member, wherein movement of the elongate member about its longitudinal axis causes the second drill rod transfer mechanism to move from a first to a second position.

While the invention will be described with respect to preferred embodiment configurations and with respect to particular devices used therein, it will be understood that the invention is not to be construed as limited in any manner by either such configuration or components described herein. Also, while the particular types of transfer mechanisms are described herein, it will be understood that such particular mechanisms are not to be construed in a limiting manner. Instead, the principles of this invention extend to any environment in which coordination and/or synchronization of moving drill rod from and/or to a drill string is desired. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

DETAILED DESCRIPTION

Reference will now be made in detail to exemplary aspects of the present invention which are illustrated in the accompanying drawings. Wherever possible, the same reference numbers are used throughout the drawings to refer to the same or like parts.

Figure 1:
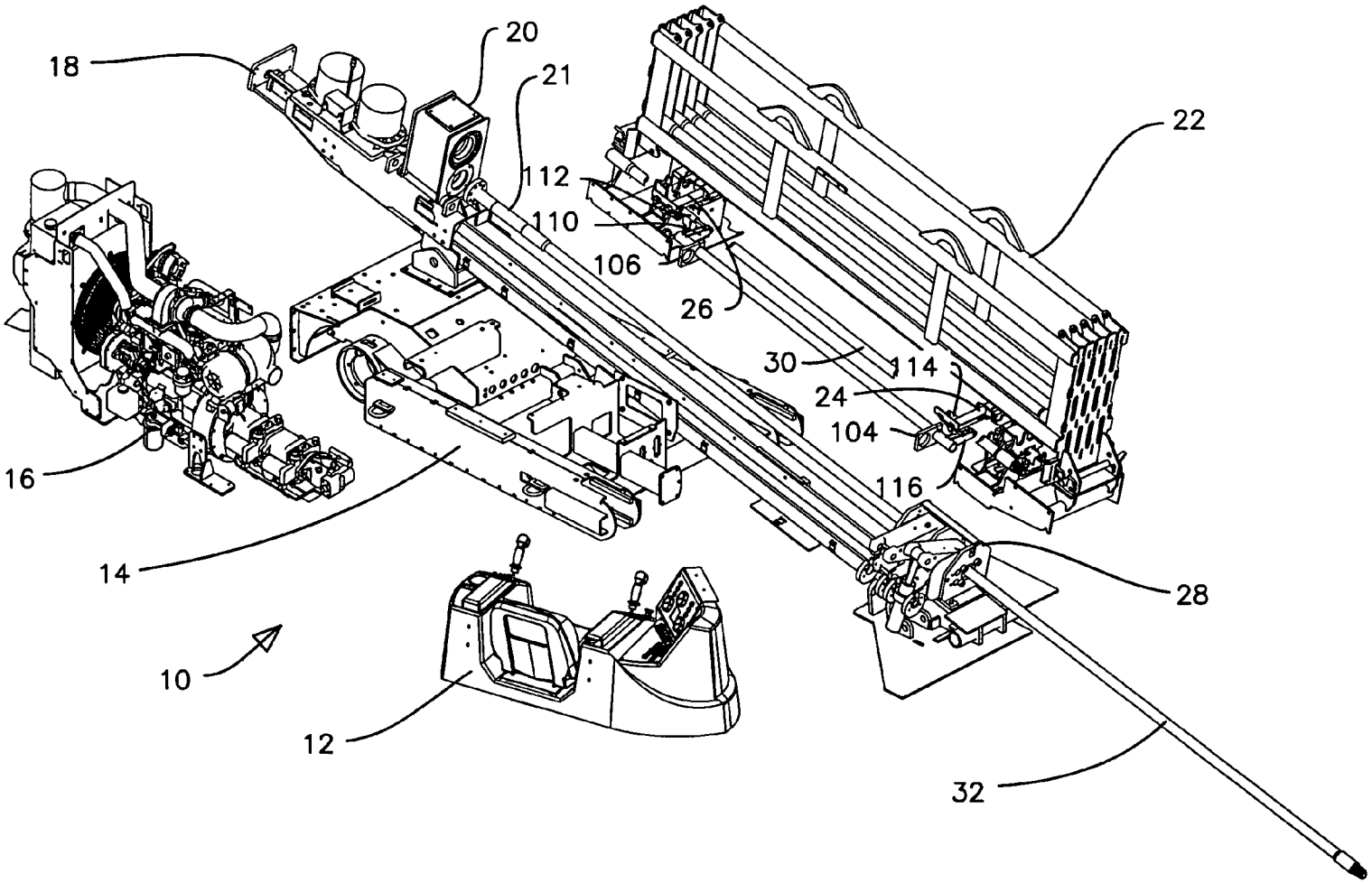
FIG. 1 is an exploded perspective view illustrating the basic components of a horizontal directional drill device including a pipe transfer mechanism synchronizer constructed in accordance with the principles of the present invention.

FIG. 1 illustrates a typical horizontal directional drill 10 including an operator console 12, a main frame 14, a power supply 16 (e.g., a prime mover), a rack frame 18, a gearbox 20 that is arranged and configured to move back and forth along the longitudinal axis of the rack frame. Spindle 21 can be independently rotated clockwise or counterclockwise. A rod magazine 22 located generally above and to the side of the rack frame stores drill rods. First or lower pipe transfer mechanism 24 is arranged and configured to move one end of the drill rod from the magazine 22 to a position in line with the drill string. Second or upper pipe transfer mechanism 26 is similarly arranged and configured to move the other end of the drill rod from the magazine to a position in line with the drill string. As used herein, the term lower refers to a position closer/nearer to the surface of the ground, while upper refers to a position that is relatively further from the ground. A vise assembly 28 is located proximate the lower pipe transfer mechanism 24. Accordingly, in operation, the pipe transfer mechanisms 24 and 26 support and transfer individual drill rod 30 from the magazine 22 and into alignment with the drill string 32 and spindle 21 of gearbox 20.

It will be appreciated that the drill rod is referred to herein as both drill rod and drill pipe. Such terms are used interchangeably herein and are not meant to denote a different type or work piece or structure.

Figure 2:
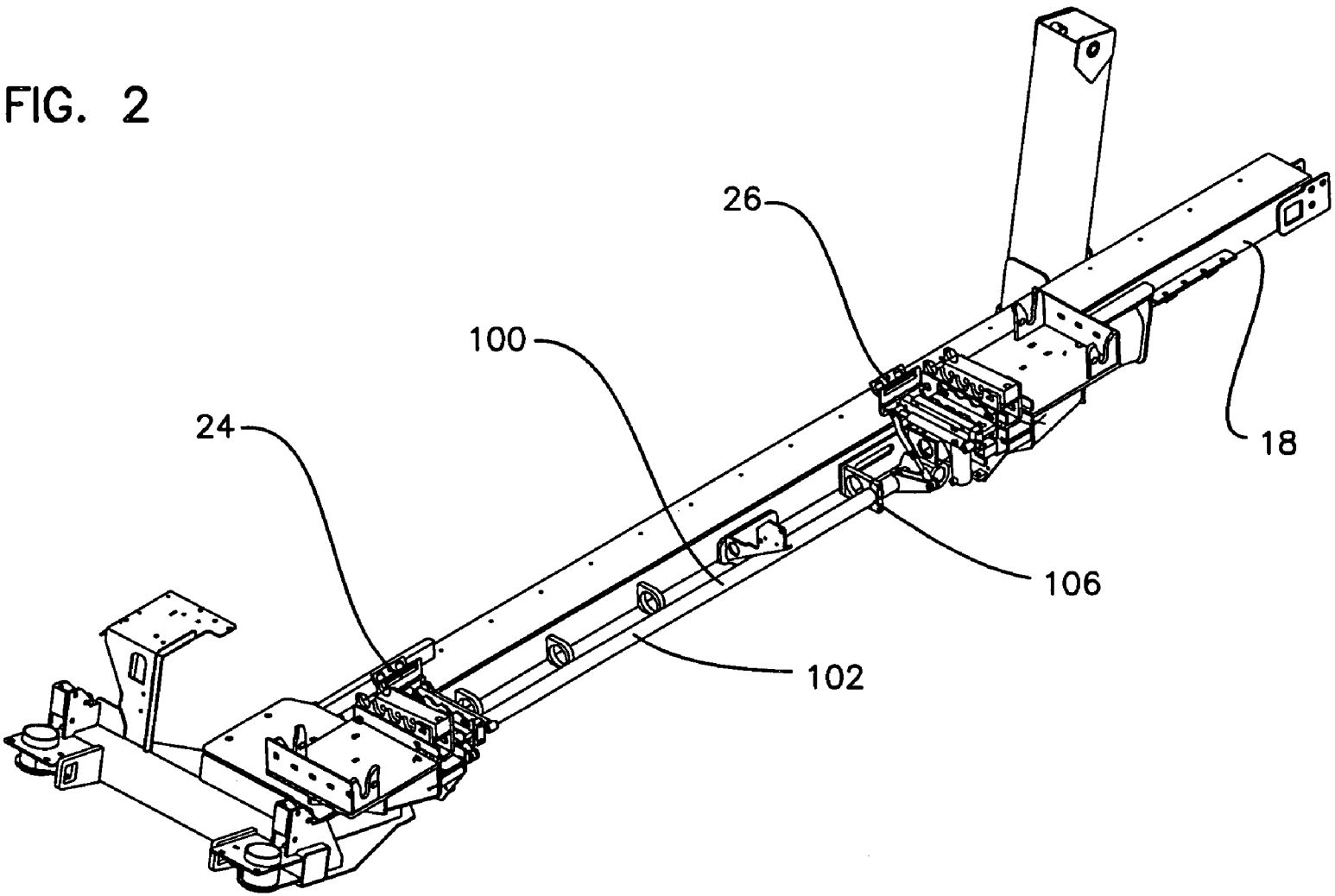
FIG. 2 is a perspective view of the drill rack frame and pipe transfer mechanisms.

Now turning to FIG. 2, a mounting arrangement of the pipe transfer mechanisms 24, 26 onto rack frame 18 are illustrated. In FIG. 2, the pipe transfer mechanisms are positioned to accept a drill rod 30 from the magazine. The transfer mechanisms 24, 26 are secured to the rack frame 18 independently (preferably in a manner that minimizes the structural components) and in a manner that allows for their relative positions being synchronized by operative connection with a transfer arm synchronizer 100 of the present invention. The transfer arm synchronizer 100 includes a synchronizer shaft 102 attached to the rack frame 18 by a pair of bearing supports. The synchronizer shaft 102 is preferably constructed as an elongate member of a length having an approximate length equal to the physical distance between the transfer mechanisms 24, 26. The length may also be extended or shortened as a matter of design choice. The synchronizer shaft 102 may be constructed of stock pipe, rod or have an I-Beam profile or other geometric shape. The functional design considerations including that the torque exerted on one end of the synchronizer shaft 102 in operation should not unduly twist and/or deform the structure (or in the case of the alternative embodiment described further below, that the force exerted between the two non-powered ends does not unduly twist or deform the structure).

Upper support 106 is illustrated in FIG. 2 as being fixedly attached to rack frame 18. Upper support 106 and lower support 104 are illustrated in the exploded view of FIG. 1 as not attached to the rack frame 18 solely for purposes of illustration. The synchronizer shaft 102 is arranged and configured to rotate freely in the supports 104 and 106 about its longitudinal axis.

Figure 3:
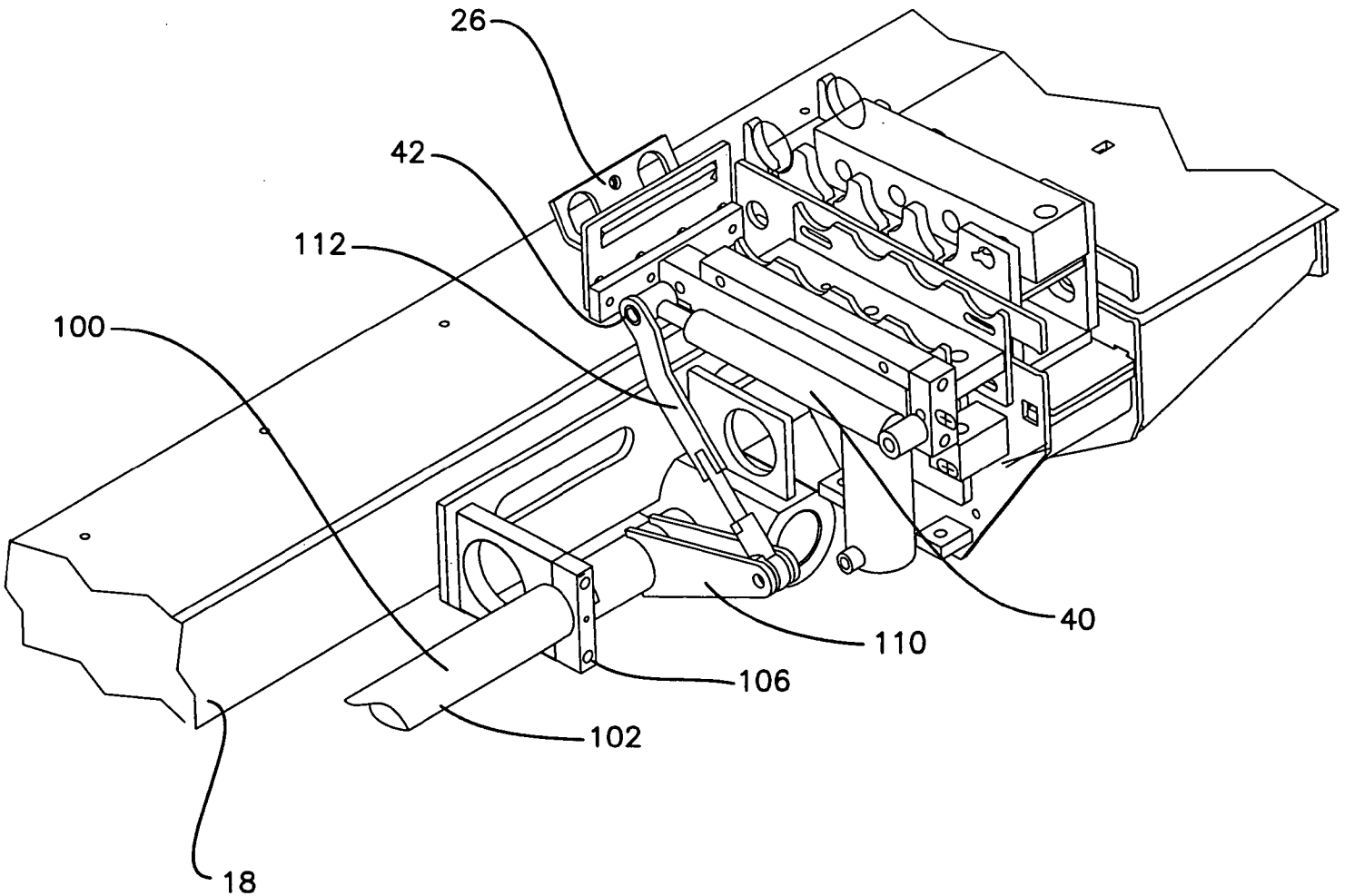
FIG. 3 is a perspective view of the drill rack frame and upper pipe transfer mechanism in a first or retracted position.
Figure 4:
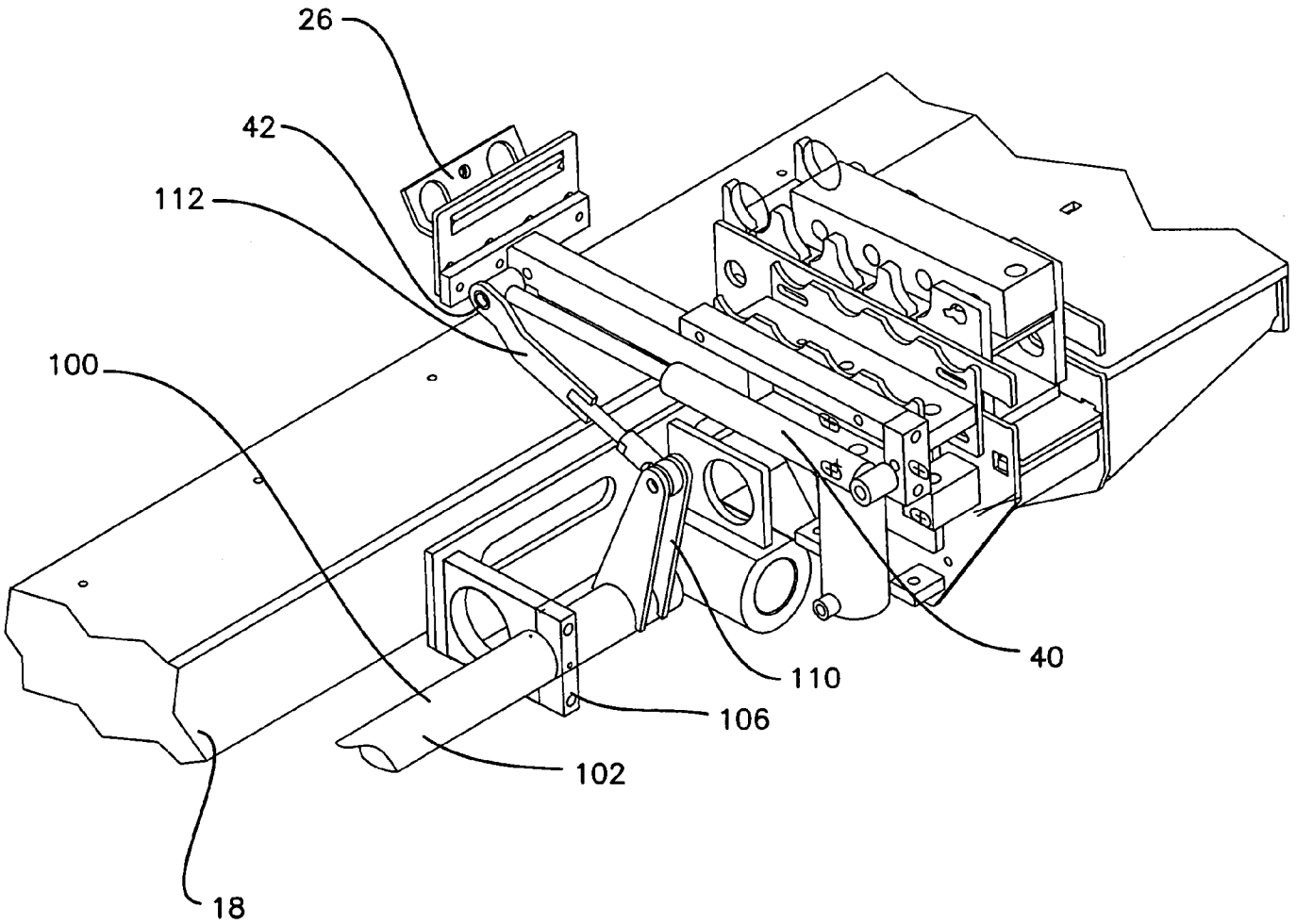
FIG. 4 is a perspective view of the drill rack frame and upper pipe transfer mechanism in a second or extended position.

Now referring to FIG. 3, link 112 connects the upper pipe transfer mechanism 26 to ear 110 that is fixedly connected to the upper end of synchronizer shaft 102. Link 114 connects the lower pipe transfer mechanism 24 to ear 116 that is fixedly connected to the lower end of synchronizer shaft 102. FIG. 3 illustrates the transfer synchronizer 100 and its attendant components in a receiving or first position (e.g., wherein the pipe transfer mechanism 26 is in the position to receive a drill rod from the magazine 22). In this position, link 112 is pivotally connected on one end to the rod end 42 of a hydraulic cylinder 40 and on the other end to the ear 110. The pivotal connection preferably includes a bushing, bearing or other friction reducing member. The pipe transfer mechanism 26 is also connected to the rod end 42 of the hydraulic cylinder 40 such that when it is extended the pipe transfer mechanism 26 is moved to the position wherein the upper end of the drill pipe will be properly positioned, as illustrated in FIG. 4.

Still referring to FIG. 3, the link 112 is pivotally connected to ear 110. The ear 110 is constructed to be fixedly attached to the synchronizer shaft 102 at its base and extends in a radial direction from the longitudinal axis of the synchronizer shaft 102. The ear 110 may be welded to the shaft, bolted or otherwise secured in place. The height of the ear 110 above the diameter of the synchronizer shaft 102 is a matter of design of the necessary and/or desired torque to be applied to the synchronizer shaft 102 (e.g., a longer ear 110 will apply a larger moment arm about the longitudinal axis). The pivotal connection between the link 112 and ear 110 may be a bushing, bearing or other friction reducing member. The ear 110 is preferably connected proximate the first end of the synchronizer shaft 102.

Link 112 may include a threaded portion for purposes of adjusting the length of the link to accommodate manufacturing tolerances and installation. Further, link 112 may include a pivot connection between its first end and second end. The function of this pivot connection is to accommodate non-linearity in the movement of the pipe transfer mechanism 26 relative to the rotation of the synchronizer shaft 102. Accordingly, such pivot connection minimizes binding which may occur between the components. Link 112 is constructed of a material and in such a manner as to have the required strength to impart rotation to the synchronizer shaft 102 upon movement of the first pipe transfer mechanism.

It will be appreciated that ear 116 and link 114 may be constructed in a similar manner to ear 110 and link 112. Accordingly, the description provided herein in regard to the latter components may generally be applied to the former components. However, it will be appreciated that the ear 116 is preferably connected proximate the second end of the synchronizer shaft 102 and the link 114 is pivotally connected to the second pipe transfer mechanism 24. It will be further appreciated that differences may exist between the ears 110, 116 and links 112, 114 due to design choices and requirements.

When cylinder 40 extends to move the pipe transfer mechanism, the link 112 pulls ear 110 thereby causing the synchronizer shaft 102 to rotate in a counterclockwise direction (as viewed in FIG. 4). The rotation of the synchronizer shaft 102 transfers movement to the opposite end (i.e., to the ear 116 which is similarly connected to link 114 and lower pipe transfer mechanism 24). The lower pipe transfer mechanism can then be positioned exclusively by the force transferred through the synchronizer shaft 102 and link 116.

It will also be appreciated that while the hydraulic cylinder 40 is described as being connected to the first pipe transfer mechanism 26, the hydraulic cylinder may optionally be attached to the second pipe transfer mechanism 24. In this case, the link 114 would impart the rotation to the synchronizer shaft 102 and the link 112 would impart movement to the first pipe transfer member.

Alternatively a second cylinder (not shown), similar to hydraulic cylinder 40, may be attached to the lower pipe transfer mechanism 24 in addition to the link 114. In this configuration the synchronizer shaft 102 functions to keep the two pipe transfer mechanisms 24, 26 synchronized (i.e., in the same position relative to the rack frame 18). If the two hydraulic cylinders were to attempt to move the pipe transfer mechanisms independently, the synchronizer shaft will facilitate the devices moving more closely with one another. The hydraulic cylinders may move the pipe transfer mechanisms independently, for example, if the movement of one cylinder is restricted. This may occur if there is a problem with an internal seal or with contamination in the hydraulic fluid.

Figure 5:
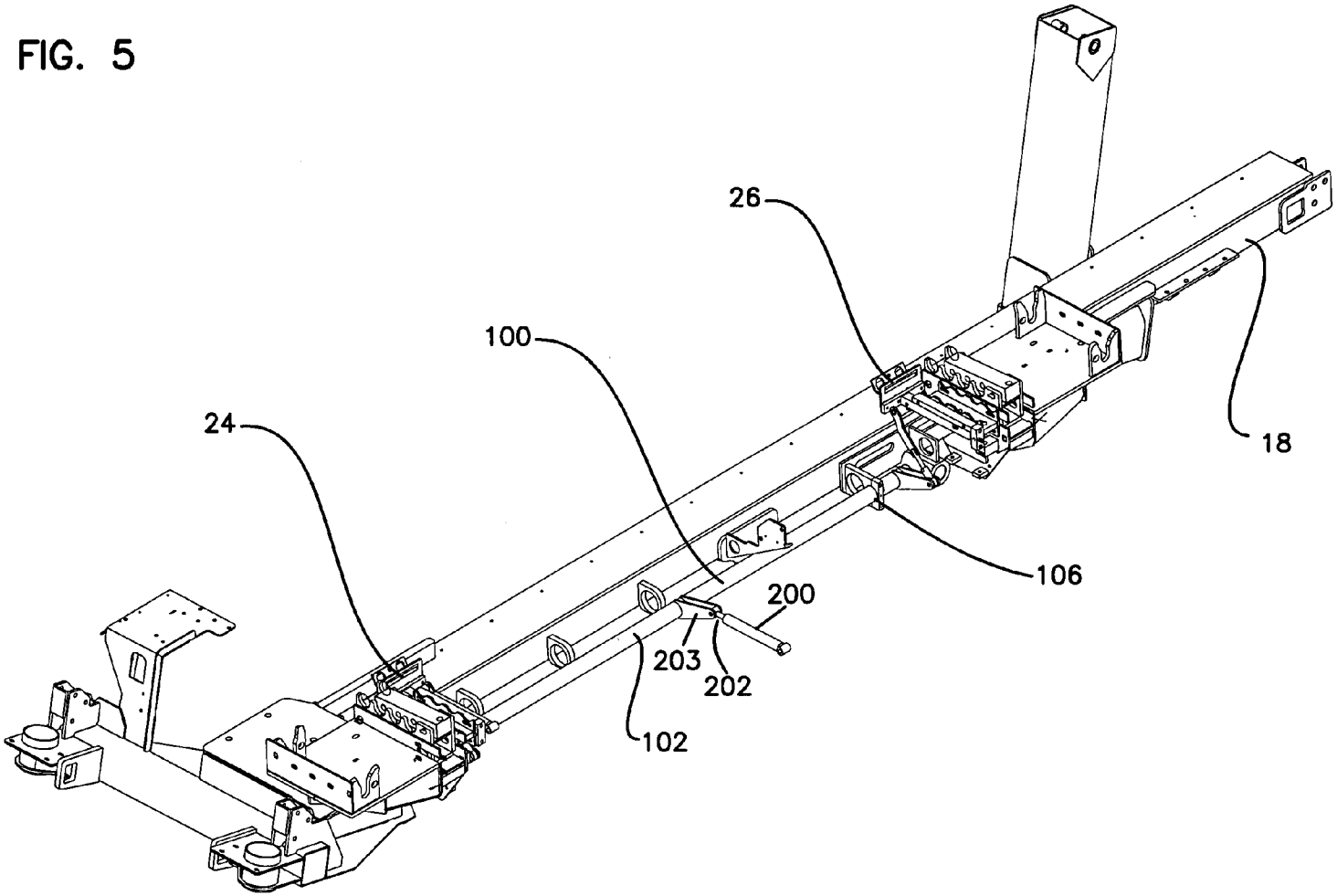
FIG. 5 is a perspective view of the drill rack frame and pipe transfer mechanisms of an alternative embodiment.

FIG. 5 illustrates an alternative embodiment 100 in which neither of the mechanisms 24 and 26 are powered. In this case an ear 203 is secured to the synchronizer shaft 102 between the two mechanisms 24 and 26. While FIG. 5 illustrates the connection being at the approximate middle of the synchronizer shaft 102, it will be appreciated that other off-center locations might be utilized. Hydraulic cylinder 200 includes an actuator arm having a yoke attached to the distal end. A retaining pin extends through the yoke and a collar on a first end of rod member 202. The resulting connection between the actuator arm and the rod member 202 allows for a pivotal connection. The second end of rod member 202 is pivotally connected to ear 203. It will be appreciated, however, that depending on the actuator stroke length and the necessary rotation of the synchronizer shaft 102, among other factors, one of the pivotal connections of rod member 202 may need to be limited to achieve the desired rotation.

In this alternative embodiment, extension and retraction of the actuator arm rotates the synchronizer shaft 102. This in turn moves each of the pipe transfer mechanisms 24 and 26 and synchronizes the movements between the mechanisms 24 and 26.

While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefore other than as described herein can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

What is claimed is:

1. A horizontal directional drilling machine, comprising:

a) a drill pipe storage magazine;

b) a boring assembly defining a drill string axis comprising a rack frame with an upper end and a lower end, a gearbox configured to travel along the rack frame from the upper end to the lower end, and a vise assembly a the lower end;

c) an upper drill pipe transfer mechanism configured to move in at least one linear segment from a retracted position, wherein it is operatively located to receive a drill pipe from the storage magazine, to an extended position, wherein the received drill pipe is aligned with the drill string;

d) a lower drill pipe transfer mechanism configured to move in at least one linear segment from a retracted position, wherein it is operatively located to receive a drill pipe from the storage magazine, to an extended position, wherein the received drill pipe is aligned with the drill string; and e) a non-powered drill pipe transfer mechanism synchronizer that connects to the upper drill pipe transfer mechanism and to the lower drill pipe transfer mechanism.

2. The horizontal directional drilling machine of claim 1, wherein the upper and lower drill pipe transfer mechanisms move only linearly.

3. The horizontal directional drilling machine of claim 1, wherein the synchronizer includes:

a) an elongate member having a longitudinal axis and extending between the upper and lower drill pipe transfer mechanisms, wherein the elongate member is rotationally mounted about its longitudinal axis;

b) a first link operatively connected to the upper drill pipe transfer mechanism and the elongate member, wherein movement of the upper drill pipe transfer mechanism from the retracted to the extended position causes rotation of the elongate member about its longitudinal axis; and c) a second link operatively connected to the lower drill pipe transfer mechanism and the elongate member, wherein rotation of the elongate member about its longitudinal axis causes the lower drill pipe transfer mechanism to move from the retracted to the extended position.

4. The horizontal directional drilling machine of claim 3, wherein the elongate member further includes:

a) a first end and a second end;

b) a first ear attached to the first end and a second ear attached to the second end; and c) wherein the first link is pivotally attached to the first ear and the second link is pivotally attached to the second ear.

5. A drill rod transfer mechanism synchronizer apparatus, the mechanism of the type that transfers drill rod from a storage magazine to a drill string in a rack, the apparatus comprising:

a) a first drill rod transfer mechanism being arranged and configured to move a drill rod when the first drill rod transfer mechanism is moved from a first receiving position to a second extended position;

b) a second drill rod transfer mechanism arranged and configured to move a drill rod when the first drill rod transfer mechanism is moved from the first receiving position to the second extended position, the second drill rod transfer mechanism being located at a physical distance on the rack from the first drill rod transfer mechanism;

c) an elongate member extending between the first and second drill rod transfer mechanisms and rotationally mounted about its longitudinal axis;

d) a first link member configured to tie the movement of the first drill rod transfer mechanism between the first receiving position and the second extended position to the rotation of the elongate member about its longitudinal axis; and e) a second link member configured to tie the movement of the second drill rod transfer mechanism between the first receiving position and the second extended position to the rotation of the elongate member about its longitudinal axis.

6. The drill rod transfer mechanism of claim 5, wherein the elongate member further includes:

a) a first end and a second end;

b) a first ear attached to the first end and a second ear attached to the second end; and c) wherein the first link is pivotally attached to the first ear and the second link is pivotally attached to the second ear.

7. The drill rod transfer mechanism of claim 6, wherein the first and second links include a pivotal connection to the first and second drill rod transfer mechanism, respectively.

8. The drill rod transfer mechanism of claim 7, wherein the first and second links include a pivoting middle section, the pivoting middle section being oriented generally normal to the pivotal connection of the first and second links to the first and second drill rod transfer mechanisms.

9. The drill rod transfer mechanism of claim 5, wherein the elongate member includes a length of pipe.

10. The drill rod transfer mechanism of claim 9, wherein the elongate member is arranged and configured to have a length approximately corresponding to the physical distance between the first and second drill rod transfer mechanism.

11. The drill rod transfer mechanism of claim 5, wherein the first and second drill rod transfer mechanism move linearly.

12. The drill rod transfer mechanism of claim 5, wherein the elongate member further includes:

a) a first end, a middle portion, and a second end;

b) a first ear attached to the first end, a second ear attached to the second end, and a third ear attached to the middle portion;

c) wherein the first link is pivotally attached to the first ear and the second link is pivotally attached to the second ear; and d) wherein movement of the third ear about the elongate member causes rotation of the elongate member and the first and second drill rod transfer mechanisms to move from the first to the second position.

13. The drill rod transfer mechanism of claim 12, wherein extension of an actuator arm of a hydraulic cylinder causes the rotation of the third ear.

14. A method for synchronizing the movement of a plurality of drill rod transfer mechanisms, the drill rod transfer mechanisms of the type that transfers drill rod from a storage magazine to a drill string in a rack, the method comprising:

a) rotationally mounting an elongate member having a longitudinal axis between a first and a second drill rod transfer mechanism;

b) connecting the first drill rod transfer mechanism to the elongate member, wherein movement of the first drill rod transfer mechanism from a first to a second position causes rotation of the elongate member about its longitudinal axis; and c) connecting the second drill rod transfer mechanism and the elongate member, wherein movement of the elongate member about its longitudinal axis causes the second drill rod transfer mechanism to move from a first to a second position;

wherein the first position of the first transfer mechanism and second position of the first transfer mechanism are at different distances from the elongated member.

15. A drill rod transfer mechanism synchronizer apparatus, the mechanism of the type that transfers drill rods from a storage magazine to a drill string in a rack, the apparatus comprising:

a) a first drill rod transfer mechanism being arranged and configured to move from a first receiving position to a second extended position;

b) a second drill rod transfer mechanism arranged and configured to move from a first receiving position to a second extended position, the second drill rod transfer mechanism being located at a physical distance on the rack from the first drill rod transfer mechanism;

c) an elongate member extending between the first and second drill rod transfer mechanisms and rotationally mounted about its longitudinal axis;

d) a first link operatively connected to the first drill rod transfer mechanism and the elongate member, wherein movement of the first drill rod transfer mechanism from the first to the second position causes rotation of the elongate member about its longitudinal axis;

e) a second link operatively connected to the second drill rod transfer mechanism and the elongate member, wherein movement of the elongate member about its longitudinal axis causes the second drill rod transfer mechanism to move from the first to the second position; and f) wherein the first and second drill rod transfer mechanisms move linearly.

16. The drill rod transfer mechanism of claim 15, wherein the elongate member further includes:

a) a first end and a second end;

b) a first ear attached to the first end and a second ear attached to the second end; and c) wherein the first link is pivotally attached to the first ear and the second link is pivotally attached to the second ear.

17. The drill rod transfer mechanism of claim 16, wherein the first and second links include a pivotal connection to the first and second drill rod transfer mechanisms, respectively.

* * * * *

UNITED STATES PATENT AND TRADEMARK OFFICE

CERTIFICATE OF CORRECTION

PATENT NO. : 7,562,724 B2
APPLICATION NO. : 11/330825
DATED : July 21, 2009
INVENTOR(S) : Allred et al.

It is certified that error appears in the above-identified patent and that said Letters Patent is hereby corrected as shown below:

Col. 6, line 45, claim 1: "vise assembly a the" should read --vise assembly at the--

Signed and Sealed this

Twenty-fourth Day of November, 2009

David J. Kappos

David J. Kappos
*Director of the United States Patent and Trademark Office*